US010973338B2

(12) United States Patent
Love

(10) Patent No.: US 10,973,338 B2
(45) Date of Patent: Apr. 13, 2021

(54) MATTRESS ROTATING SYSTEM

(71) Applicant: Janis Love, Casper, WY (US)

(72) Inventor: Janis Love, Casper, WY (US)

( * ) Notice: Subject to any disclaimer, the term of this patent is extended or adjusted under 35 U.S.C. 154(b) by 332 days.

(21) Appl. No.: 15/985,806

(22) Filed: May 22, 2018

(65) Prior Publication Data

US 2019/0357693 A1 Nov. 28, 2019

(51) Int. Cl.
*A47C 21/06* (2006.01)
*A61G 7/018* (2006.01)

(52) U.S. Cl.
CPC ..... *A47C 21/06* (2013.01); *A61G 7/018* (2013.01)

(58) Field of Classification Search
CPC ..... A47C 21/06; A61G 7/018; A61G 7/1076; A61G 7/012; B66F 7/0641; B66F 3/08; B66F 3/44
See application file for complete search history.

(56) References Cited

U.S. PATENT DOCUMENTS 3,104,139 A * 9/1963 Thompson ..... A47C 9/08 312/235.5
3,333,553 A * 8/1967 Krokos ..... B60P 7/14 410/128
3,516,097 A * 6/1970 Angus ..... A47C 21/028 5/412
4,312,500 A * 1/1982 Janssen ..... A61G 15/02 5/601
5,149,043 A * 9/1992 Grundmann ..... A47B 11/00 108/139
5,414,882 A 5/1995 Goodale
5,479,867 A * 1/1996 Blevins ..... A47B 49/00 108/22
5,497,518 A 3/1996 Iura
6,457,196 B1 10/2002 Dykes
6,877,811 B1 * 4/2005 Garelick ..... A47C 3/18 248/418
6,941,594 B1 * 9/2005 Mosley ..... A47C 19/00 5/11
7,373,677 B2 * 5/2008 Barthelt ..... A61G 7/015 5/612
D622,531 S 8/2010 Morrison
7,941,879 B2 * 5/2011 Burnett ..... A47C 17/86 5/11
8,006,331 B1 8/2011 Scarleski
8,578,529 B2 * 11/2013 Miyano ..... A61B 6/0457 5/601

(Continued)

FOREIGN PATENT DOCUMENTS

FR 2887438 A1 * 12/2006 ..... A61G 7/053

*Primary Examiner* — David R Hare
*Assistant Examiner* — Alexis Felix Lopez

(57) ABSTRACT

A mattress rotating system for lifting and rotating a mattress includes a box spring that has a top side, a bottom side and a perimeter wall that is attached to and extends between the top side and the bottom side. The perimeter wall includes a front side, a back side, a first lateral side and a second lateral side. The box spring has an opening that extends through the top side. A lifting unit is mounted in the box spring and is extendable upwardly from the box spring. The lifting unit is rotatable relative to the box spring. A mattress is positioned on the lifting unit and the lifting unit is actuated to lift the mattress upwardly from the box spring such that the mattress is rotatable with respect to the box spring.

7 Claims, 8 Drawing Sheets

(56) References Cited

U.S. PATENT DOCUMENTS

| | | | | |
|---|---|---|---|---|
| 9,265,351 | B2 * | 2/2016 | Koorey | A47C 19/045 |
| 9,743,776 | B2 * | 8/2017 | Ray | A47C 19/045 |
| 2004/0187213 | A1 * | 9/2004 | Wang | A61G 7/012 5/618 |
| 2006/0061177 | A1 * | 3/2006 | Billger | B60N 2/0228 297/344.21 |
| 2007/0283494 | A1 * | 12/2007 | Vasey | A47C 19/045 5/488 |
| 2009/0255056 | A1 * | 10/2009 | Burnett | A47C 19/045 5/11 |
| 2010/0223722 | A1 * | 9/2010 | Burnett | A61G 7/018 5/11 |
| 2011/0109135 | A1 * | 5/2011 | Davis, Jr. | A47C 7/72 297/217.4 |
| 2013/0193392 | A1 * | 8/2013 | McGinn | B66F 7/243 254/93 R |
| 2015/0342358 | A1 * | 12/2015 | Murphy | A47C 17/86 5/400 |

* cited by examiner

MATTRESS ROTATING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mattress turning devices and more particularly pertains to a new mattress turning device for lifting and rotating a mattress.

BRIEF SUMMARY OF THE INVENTION

An embodiment of the disclosure meets the needs presented above by generally comprising a box spring that has a top side, a bottom side and a perimeter wall that is attached to and extends between the top side and the bottom side. The perimeter wall includes a front side, a back side, a first lateral side and a second lateral side. The box spring has an opening that extends through the top side. A lifting unit is mounted in the box spring and is extendable upwardly from the box spring. The lifting unit is rotatable relative to the box spring. A mattress is positioned on the lifting unit and the lifting unit is actuated to lift the mattress upwardly from the box spring such that the mattress is rotatable with respect to the box spring.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
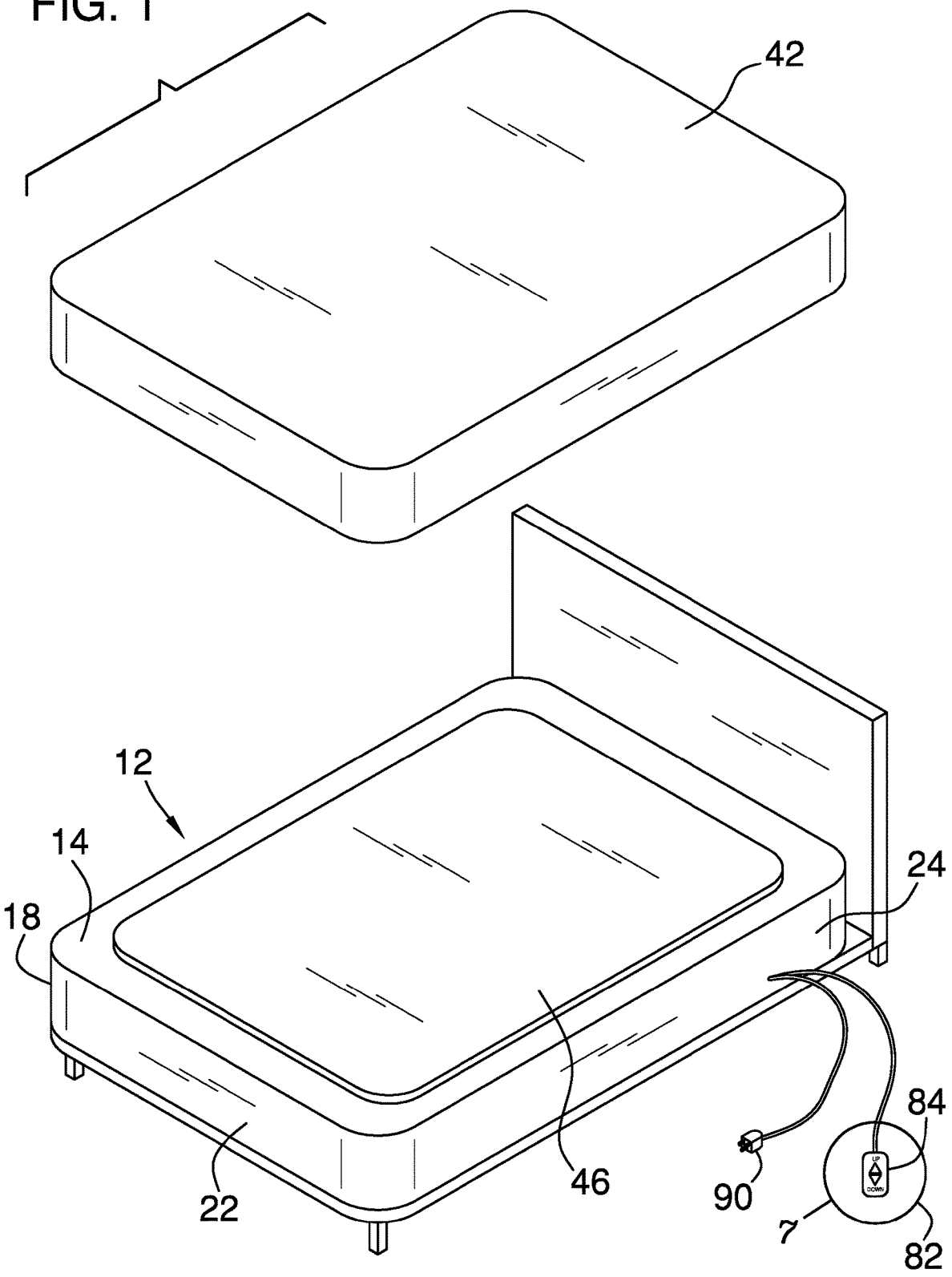
FIG. 1 is a top side view of a mattress rotating system according to an embodiment of the disclosure.
Figure 2:
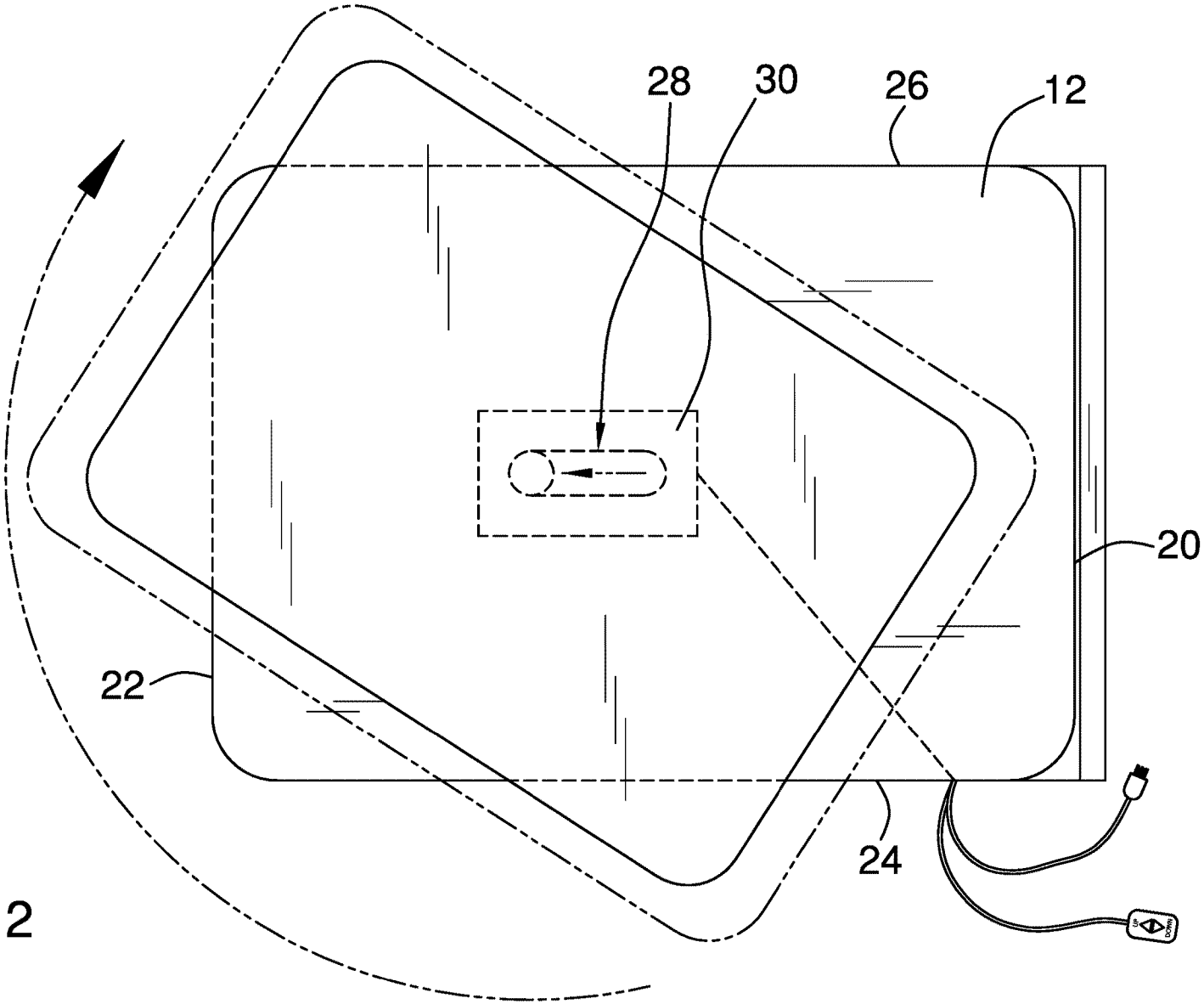
FIG. 2 is a top view of an embodiment of the disclosure.
Figure 3:
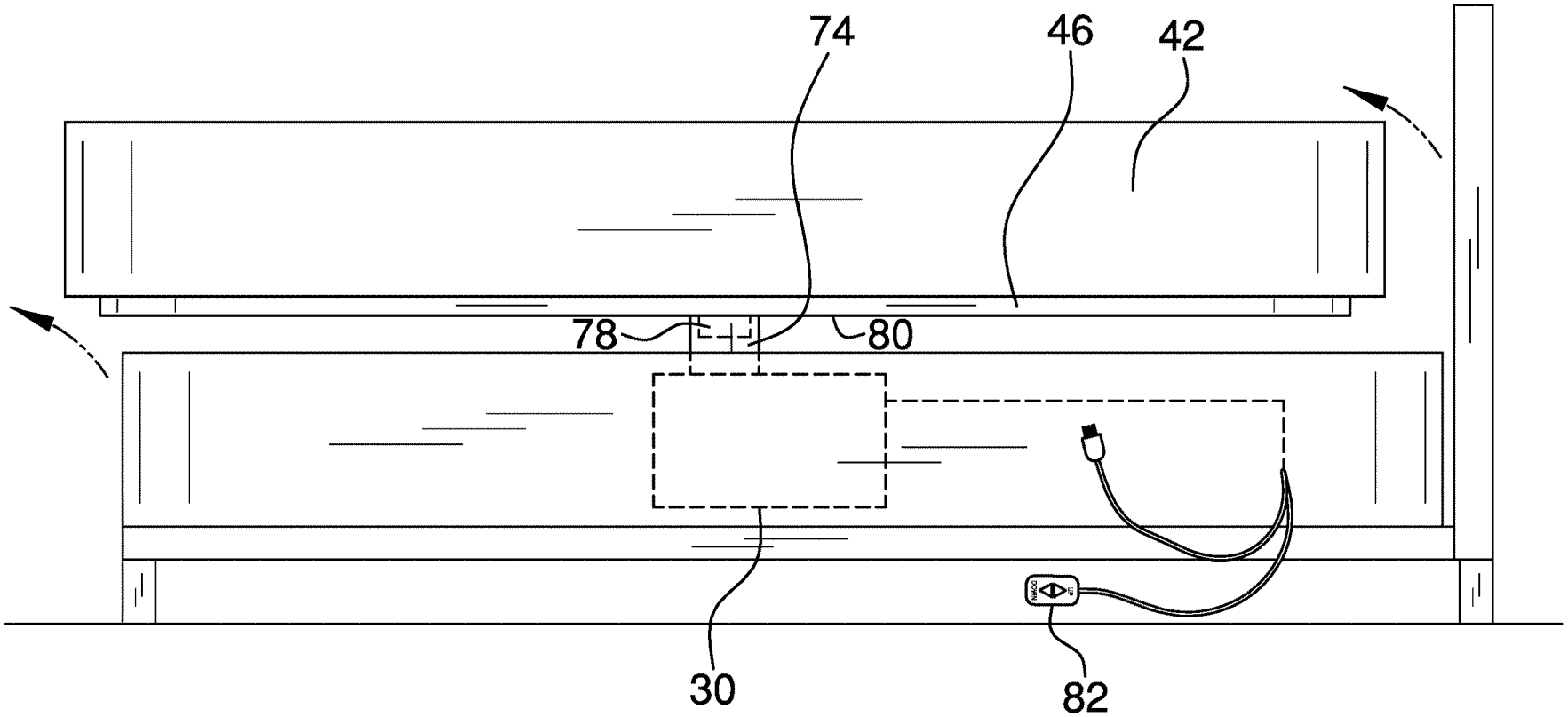
FIG. 3 is a side view of an embodiment of the disclosure.
Figure 4:
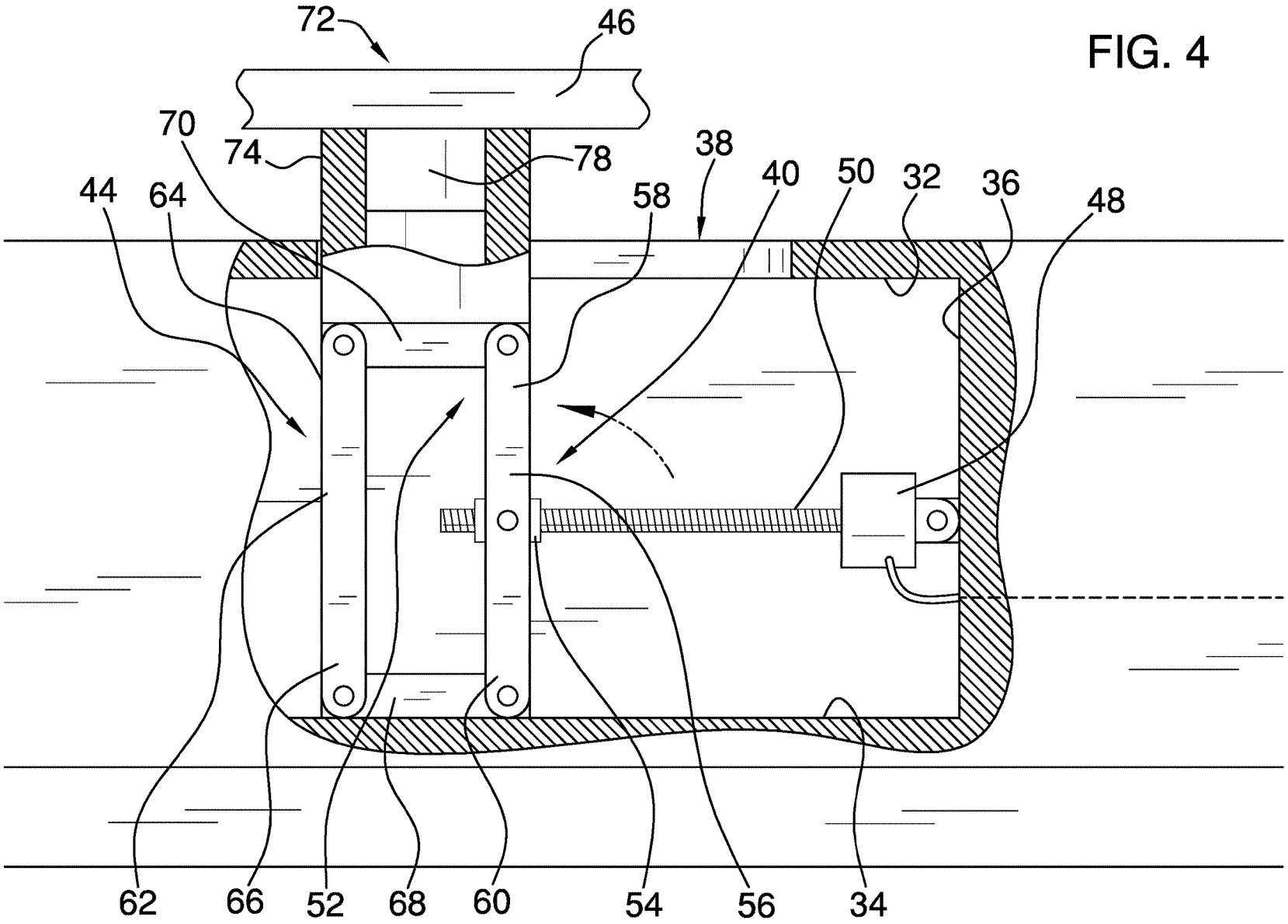
FIG. 4 is a side view of an embodiment of the disclosure.
Figure 5:
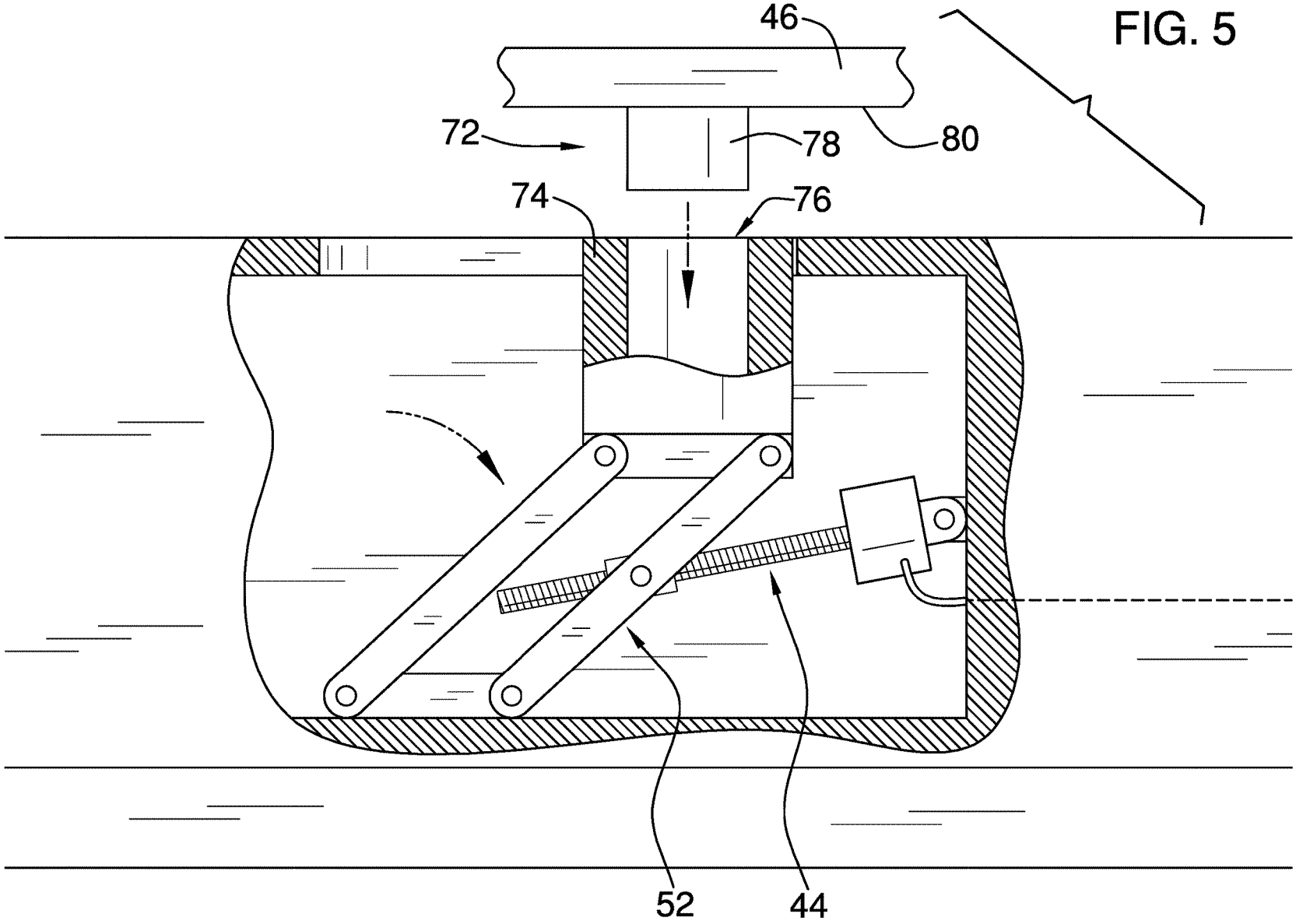
FIG. 5 is a side view of an embodiment of the disclosure.
Figure 6:
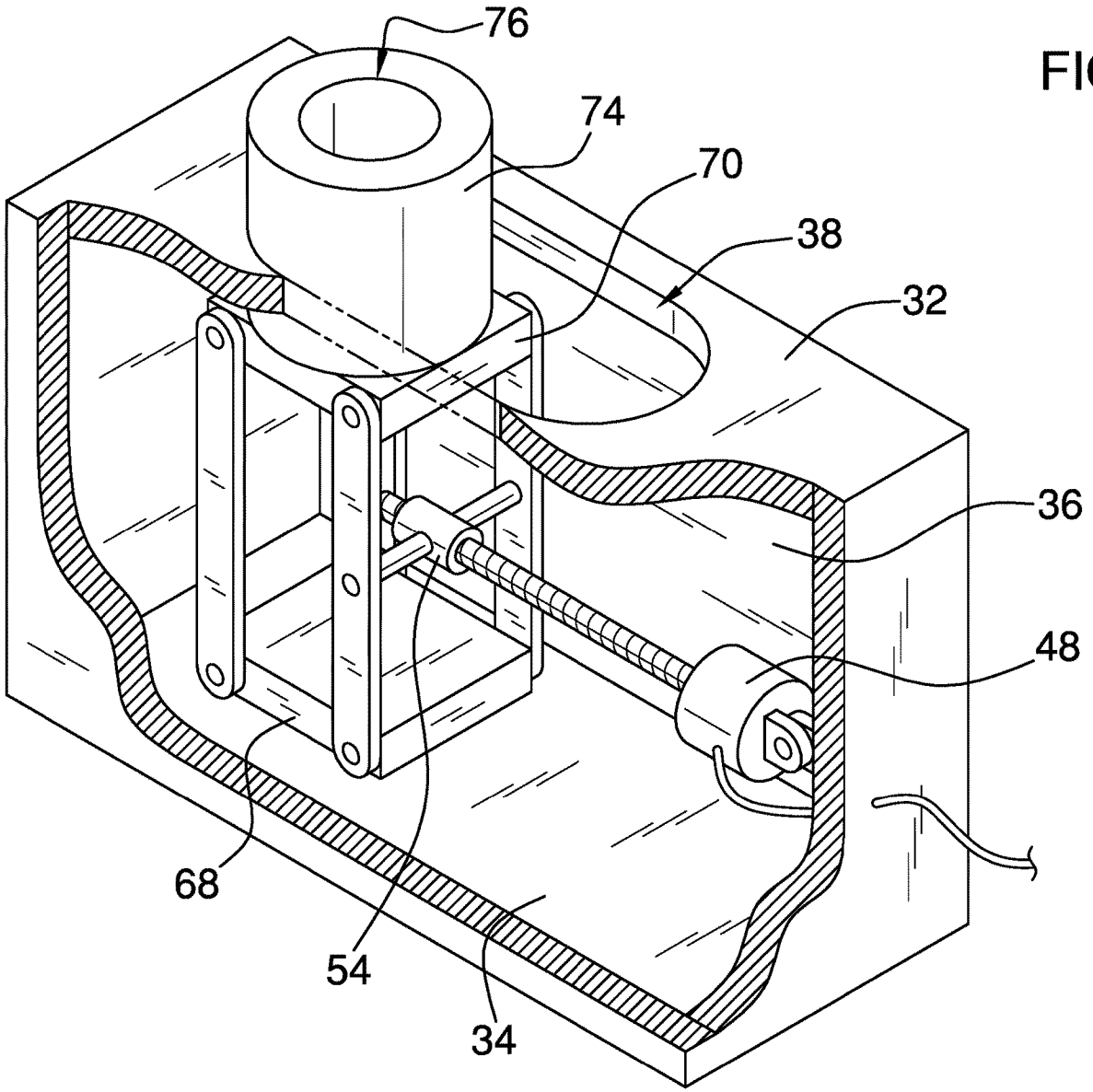
FIG. 6 is a top side view of an embodiment of the disclosure.
Figure 7:
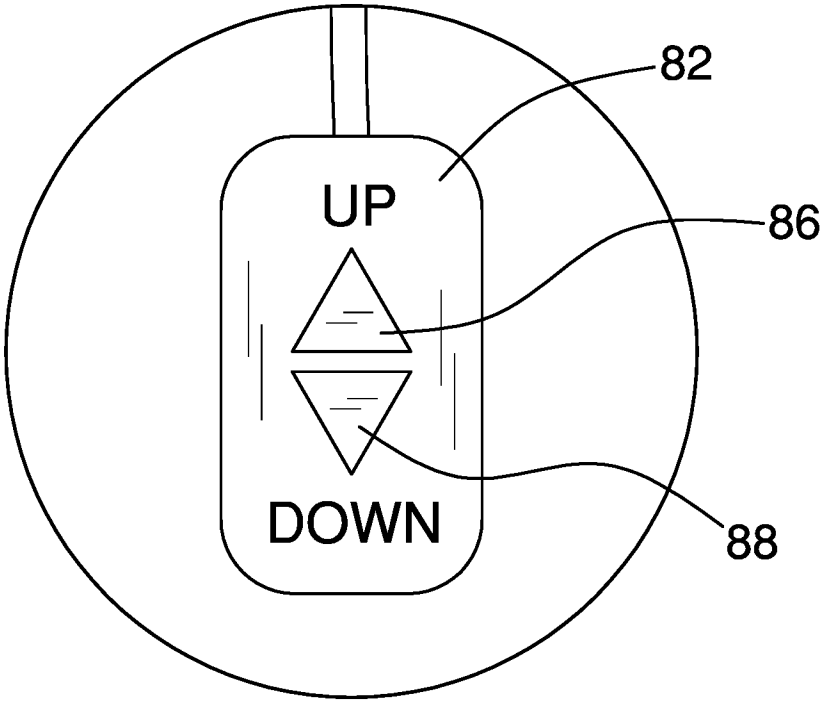
FIG. 7 is a top view of an embodiment of the disclosure.
Figure 8:
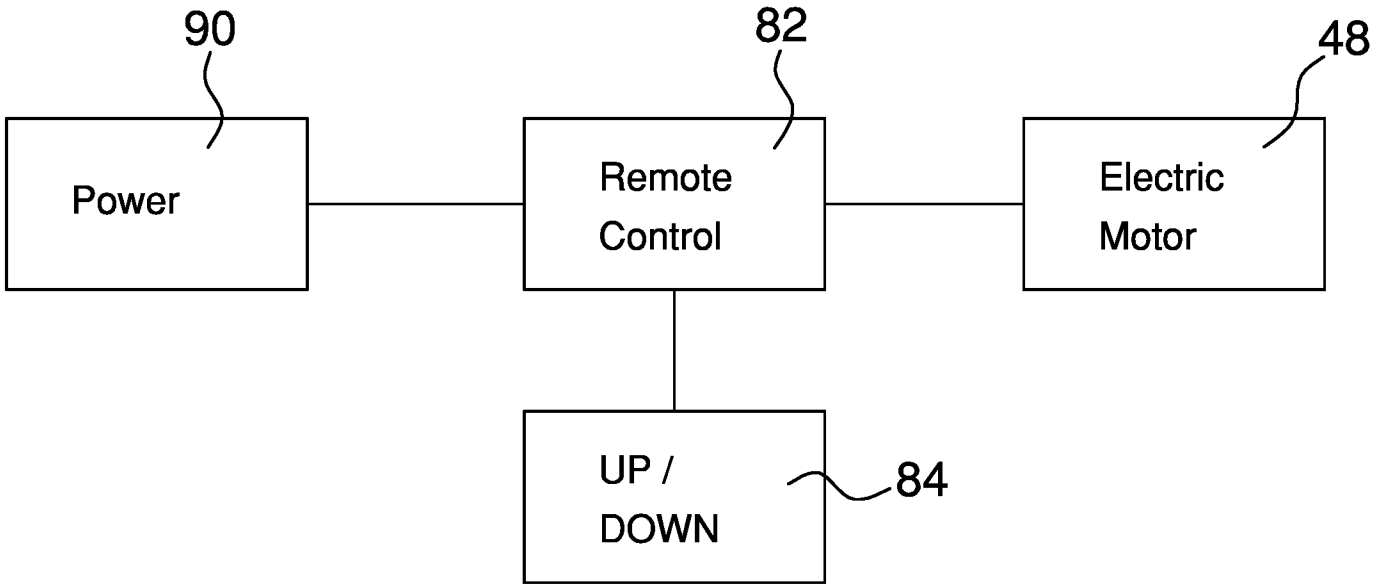
FIG. 8 is a schematic box diagram of an embodiment of the disclosure.

With reference now to the drawings, and in particular to FIGS. 1 through 8 thereof, a new mattress turning device embodying the principles and concepts of an embodiment of the disclosure and generally designated by the reference numeral 10 will be described.

As best illustrated in FIGS. 1 through 8, the mattress rotating system 10 generally comprises a box spring 12 that has a top side 14, a bottom side 16 and a perimeter wall 18 is attached to and extends between the top side 14 and the bottom side 16. The perimeter wall 18 includes a front side 20, a back side 22, a first lateral side 24 and a second lateral side 26. The box spring 12 has an opening 28 that extends through the top side 14.

A housing 30 is positioned within the box spring 12. The housing 30 includes a top wall 32, a bottom wall 34 and a peripheral wall 36 that extends between the top wall 32 and the bottom wall 34. The top wall 32 has an orifice 38 that extends through the top wall 32 into the housing 30. The orifice 38 is aligned with the opening 28.

A lifting unit 40 is mounted in the housing 30 and is extendable upwardly from the box spring 12. The lifting unit 40 is rotatable relative to the box spring 12. A mattress 42 is positioned on the lifting unit 40 and is actuated to lift the mattress 42 upwardly from the box spring 12 such that the mattress 42 is rotatable with respect to the box spring 12.

The lifting unit 40 includes a jack assembly 44 and a platform 46 that is rotatably attached to the jack assembly 44. The mattress 42 is positioned on the platform 46. The jack assembly 44 includes a motor 48 that is hingedly coupled to the peripheral wall 36. A drive rod 50 that is mechanically coupled to the motor 48 and 50 rotates in a first direction or a second direction when the motor 48 is turned on and actuated in a first direction or a second direction. The motor 48 is an electric motor and is threaded.

A lifting frame 52 is threadably coupled to the drive rod 50. The lifting frame 52 alternates between a lifted positioned and a resting position when the motor 48 is powered. The lifting frame 52 extends the platform 46 upwardly from the box spring 12 when the motor 48 is rotated in the first direction. The lifting frame retracts the platform 46 downwardly toward the box spring 12 when the motor 48 is rotated in the second direction.

The lifting frame 52 includes a coupler 54 is threadably coupled to the drive rod 50. A pair of front braces 56 is hingedly coupled to the coupler 54. The front braces 56 have an upper portion 58 and a lower portion 60. A pair of back braces 62 is included and each has an upper section 64 and a lower section 66. A first plate 68 is hingedly coupled and extends between the lower portions 60 and the lower sections 66.

A second plate 70 is hingedly coupled and extends between the upper portions 60 and the upper sections 64. The first plate 68 is attached to the bottom wall 34 such that when the drive rod 50 rotates in a first direction the coupler 54 moves horizontally along the drive rod 50 moving the pair of front braces 56 and the pair of back braces 62 away from the motor 48 such that the second plate 70 extends upwardly toward the opening 28 into the lifted position. The lifting frame 52 is reverted back to a resting position when the motor 48 is rotated in the second direction.

A rotating unit 72 is attached to the lifting frame 52. The rotating unit 72 facilitates the rotation of the mattress 42 when the lifting frame 52 is in the lifted position. The rotating unit 72 includes a tube 74 that is positioned on the lifting frame 52 such that an aperture 76 of the tube 74 is exposed upwardly from the lifting unit 40. The tube 74 comprises a friction reducing material. The platform 46 extends over the box spring 12. A male mating member 78 is attached to and extends downwardly from a lower side 80 of the platform 46. The male mating member 78 is positioned in the aperture 76 such that the platform 46 is rotatably attached to the tube 74.

A control 82 is electrically coupled to the motor 48. The control 82 includes a plurality of buttons 84. Each of the buttons 84 controls operational parameters of the motor 48. A first one 86 of the plurality of buttons 84 lifts the lifting frame 52 to the lifted position. A second one 88 of the plurality of buttons 84 lowers the lifting frame 52 into the resting position. A power supply 90 is electrically coupled to the motor 48 and the control 82.

In use, the mattress 42 is positioned on the platform 46. To rotate the mattress 42 the first one of the plurality of buttons 86 is pressed to lift the lifting frame 52. The lifting frame 52 is then moved into the raised position. The platform 46 is rotated 180° relative to a starting position. The second one of the plurality of buttons 88 is pressed to lower the lifting frame 52 and the lifting frame 52 is returned to the resting position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mattress support and rotating system configured to lift and facilitate the rotation of a mattress, said system comprising:

a box spring having a top side, a bottom side and a perimeter wall being attached to and extending between said top side and said bottom side, said perimeter wall including a front side, a back side, a first lateral side and a second lateral side, said box spring having an opening that extends through said top side;

a lifting unit being mounted in said box spring and being extendable upwardly from said box spring, said lifting unit being rotatable relative to said box spring;

a mattress being positioned on said lifting unit, said lifting unit being actuated to lift said mattress upwardly from said box spring such that said mattress is rotatable with respect to said box spring; and a housing positioned within said box spring, said housing including a top wall, a bottom wall and a peripheral wall that extends between said top wall and said bottom wall, said top wall having an orifice that extends through said top wall into said housing, said orifice being aligned with said opening.

2. The mattress support and rotating system according to claim 1, wherein said lifting unit includes a jack assembly and a platform rotatably attached to said jack assembly, said mattress being positioned on said platform.

3. The mattress support and rotating system according to claim 2, wherein said jack assembly includes:

a motor positioned in the box spring;

a drive rod being mechanically coupled to said motor, said drive rod rotating in a first direction or a second direction when said motor is turned on and actuated in a first direction or a second direction, said motor being an electric motor, said drive rod being threaded; and a lifting frame being threadably coupled to said drive rod, said lifting frame alternating between a lifted positioned and a resting position when said motor is powered, said lifting frame extending said platform upwardly from said box spring when said motor is rotated in said first direction, said lifting frame retracting said platform downwardly toward said box spring when said motor is rotated in said second direction; and a rotating unit being attached to said lifting frame, said rotating unit facilitating the rotation of said mattress when said lifting frame is in said lifted position.

4. The mattress support and rotating system according to claim 3, said lifting frame includes:

a coupler being threadably coupled to said drive rod;

a pair of front braces being hingedly coupled to said coupler, said front braces having an upper portion and a lower portion;

a pair of back braces having a upper section and a lower section;

a first plate being hingedly coupled and extending between said lower portions and said lower sections; and a second plate being hingedly coupled and extending between said upper portions and said upper sections, said first plate being attached to an inside surface of said bottom side such that when said drive rod rotates in a first direction said coupler moves horizontally along said drive rod moving said pair of front braces and said pair of back braces away from said motor such that said second plate extends upwardly toward said opening into said lifted position, said lifting frame being reverted back to a resting position when said motor is rotated in said second direction.

5. The mattress support and rotating system according to claim 3, wherein the rotating unit includes:

a tube being positioned on said lifting frame such that an aperture of said tube is exposed upwardly from said lifting unit, said tube comprising a friction reducing material;

said platform extending over said box spring; and a male mating member being attached to and extending downwardly from a lower side of said platform, said male mating member being positioned in said aperture such that said platform is rotatably attached to said tube.

6. The mattress support and rotating system according to claim 3, further including:

a control being electrically coupled to said motor, said control including a plurality of buttons, each of said buttons controlling operational parameters of said motor, a first one of said plurality of buttons lifting said lifting frame to said lifted position, a second one of said plurality of buttons lowering said lifting frame into said resting position; and a power supply being electrically coupled to said motor and said control.

7. A mattress support and rotating system configured to lift and facilitate the rotation of a mattress, said system comprising:

a box spring having a top side, a bottom side and a perimeter wall being attached to and extending between said top side and said bottom side, said perimeter wall including a front side, a back side, a first lateral side and a second lateral side, said box spring having an opening that extends through said top side;

a housing positioned within said box spring, said housing including a top wall, a bottom wall and a peripheral wall that extends between said top wall and said bottom wall, said top wall having an orifice that extends through said top wall into said housing, said orifice being aligned with said opening;

a lifting unit being mounted in said housing and being extendable upwardly from said box spring, said lifting unit being rotatable relative to said box spring;

a mattress being positioned on said lifting unit, said lifting unit being actuated to lift said mattress upwardly from said box spring such that said mattress is rotatable with respect to said box spring;

said lifting unit including a jack assembly and a platform rotatably attached to said jack assembly, said mattress being positioned on said platform;

said jack assembly including:

a motor being hingedly coupled to said perimeter wall;

a drive rod being mechanically coupled to said motor, said drive rod rotating in a first direction or a second direction when said motor is turned on and actuated in a first direction or a second direction, said motor being an electric motor, said drive rod being threaded;

a lifting frame being threadably coupled to said drive rod, said lifting frame alternating between a lifted positioned and a resting position when said motor is powered, said lifting frame extending said platform upwardly from said box spring when said motor is rotated in said first direction, said lifting frame retracting said platform downwardly toward said box spring when said motor is rotated in said second direction, said lifting frame including:

a coupler being threadably coupled to said drive rod;

a pair of front braces being hingedly coupled to said coupler, said front braces having an upper portion and a lower portion, a pair of back braces having a upper section and a lower section;

a first plate being hingedly coupled and extending between said lower portions and said lower sections;

a second plate being hingedly coupled and extending between said upper portions and said upper sections, said first plate being attached to said bottom wall such that when said drive rod rotates in a first direction said coupler moves horizontally along said drive rod moving said pair of front braces and said pair of back braces away from said motor such that said second plate extends upwardly toward said opening into said lifted position, said lifting frame being reverted back to a resting position when said motor is rotated in said second direction;

a rotating unit being attached to said lifting frame, said rotating unit being configured to facilitate the rotation of the mattress when said lifting frame is in said lifted position, the rotating unit including:

a tube being positioned on said lifting frame such that an aperture of said tube is exposed upwardly from said lifting unit, said tube comprising a friction reducing material;

said platform extending over said box spring, a male mating member being attached to and extending downwardly from a lower side of said platform, said male mating member being positioned in said aperture such that said platform is rotatably attached to said tube;

a control being electrically coupled to said motor, said control including a plurality of buttons, each of said buttons controlling operational parameters of said motor, a first one of said plurality of buttons lifting said lifting frame to said lifted position, a second one of said plurality of buttons lowering said lifting frame into said resting position; and a power supply being electrically coupled to said motor and said control.

* * * * *